US006531049B1

(12) United States Patent
Kariya et al.

(10) Patent No.: US 6,531,049 B1
(45) Date of Patent: Mar. 11, 2003

(54) METHOD OF REMOVING TI FILM AND APPARATUS

(75) Inventors: Akio Kariya; Takumi Hamajima; Satoshi Morimoto; Toshiaki Ishimaru; Akihide Kakutani, all of Shiga (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/381,714

(22) PCT Filed: Feb. 12, 1999

(86) PCT No.: PCT/JP99/00588

§ 371 (c)(1),
(2), (4) Date: Sep. 28, 1999

(87) PCT Pub. No.: WO99/41435

PCT Pub. Date: Aug. 19, 1999

(30) Foreign Application Priority Data

Feb. 13, 1998 (JP) ..... 10-031018

(51) Int. Cl.[7] ..... C25F 5/00; C25B 9/00
(52) U.S. Cl. ..... 205/717; 204/274
(58) Field of Search ..... 205/640, 705, 205/717, 674, 718, 719, 720–723; 216/108, 100, 103; 134/41; 148/259, 256, DIG. 51, DIG. 135; 204/274

(56) References Cited

U.S. PATENT DOCUMENTS 4,886,588 A * 12/1989 Curfman ..... 205/717
5,062,941 A * 11/1991 Sue ..... 205/717
5,202,003 A * 4/1993 Gordon ..... 205/717
5,507,926 A * 4/1996 Keller et al. ..... 205/717 X

* cited by examiner

*Primary Examiner*—Donald R. Valentine
(74) *Attorney, Agent, or Firm*—Birch, Stewart, Kolasch & Birch, LLP

(57) ABSTRACT

An aqueous solution (20) of an alkali hydroxide is stored and held in a tank (1). An electrode (5) is disposed in the tank (1), and a member (11) coated with a Ti-derived film is disposed in the tank (1) so as to be surrounded with the electrode (5). In this state, a power source (6) applies a negative potential to the electrode (5) and a positive potential to the member (11) to flow electricity between the electrode (5) and the member (11) immersed in the aqueous solution (20). Thus, the Ti-derived film coated on the surface of the member (11) is chemically removed by the aqueous solution (20).

8 Claims, 2 Drawing Sheets

METHOD OF REMOVING TI FILM AND APPARATUS

This application is the national phase under 35 U.S.C. §371 of PCT International Application No. PCT/JP99/00588 which has an International filing date of Feb. 12, 1999, which designated the United States of America.

TECHNICAL FIELD

This invention relates to a method and an apparatus for removing a Ti-derived film coated on the surface of a cutting tool or the like.

BACKGROUND ART

In recent years, cutting tools having a Ti-derived film, such as a titanium nitride film or a titanium carbide film, coated on the surface of high speed tool steels for improved wear resistance have been in frequent use. In such a cutting tool, the film on a cutting part wears earlier than the film at other sites during use of the cutting tool. After a predetermined period of use, therefore, the film is entirely removed, and the cutting part is cut for readjustment. Then, a Ti-derived film is coated on the cutting tool for recycling. If the coated film deviates from the standard values during the Ti-derived film coating process, all the film is removed, and then the cutting tool is coated again for recycling.

Such removal of a Ti-derived film for recycling is disclosed, for example, in Japanese Unexamined Patent Publication No. 5-112885. According to a method for removing a titanium coated film disclosed in this publication, a cutting tool having a Ti-derived film (TiN, TiC, TiCN or Ti) coated on a base material of high speed tool steel is immersed (12 hours) at a temperature of 10 to 40° C. in a mixed aqueous solution containing 1 to 20% by weight of a polymerized phosphoric acid alkali salt, 1 to 10% by weight of one or more of hydroxy carbonate-derived organic acid alkali salts, 2 to 15% by weight of an ethylenediamine-acetic acid alkali salt, 0.1 to 5% by weight of an alkali hydroxide, and 3 to 7% by weight of hydrogen peroxide. By so doing, the Ti-derived film is removed.

As noted above, with the method of titanium-coated film removal disclosed in the publication, the cutting tool coated with the Ti-derived film is immersed for a predetermined time (12 hours) in a predetermined mixed aqueous solution to remove the Ti-derived film. Removal of the Ti-derived film takes a long time (film removal rate: about 0.3 $\mu$m/h), meaning a poor efficiency of treatment. Particularly in removing a TiAlN film, it cannot be removed even when immersing the cutting tool for 60 hours in the aqueous solution. In this case, the film removal rate is less than 0.1 $\mu$m/h.

Under these circumstances, the present invention has as an object the provision of a method and an apparatus for removing a Ti-derived film, the method and apparatus being capable of efficiently removing the Ti-derived film coated on the surface of a member.

DISCLOSURE OF THE INVENTION

The present invention is a method for removing a Ti-derived film, which comprises immersing an electrode and a member coated with the Ti-derived film in a solution having an $OH^-$ ion concentration of $10^2$ to $10^{-4}$ mol/l, and applying a positive potential to the member, and a negative potential to the electrode.

Thus, the Ti-derived film coated on the surface of the member can be removed efficiently.

The present invention is also the method for removing a Ti-derived film, wherein the solution is an aqueous solution containing an alkali hydroxide and having a pH of 10 or greater. Thus, removal of the Ti-derived film coated on the surface of the member can be performed easily.

The present invention is also the method for removing a Ti-derived film, wherein the temperature of the aqueous solution is kept at room temperature to the boiling temperature of the aqueous solution. Thus, the Ti-derived film coated on the surface of the member can be removed in a short time.

The present invention is also the method for removing a Ti-derived film, wherein the aqueous solution is kept at a predetermined temperature by initially raising its temperature by heating, and then raising its temperature by the heat of reaction. Thus, removal of the Ti-derived film can be performed from the start of the operation, and the surface of the member deprived of the Ti-derived film can be finished to be smooth.

The present invention is also the method for removing a Ti-derived film, wherein the solution is a solution of an alkali hydroxide melted in a solvent consisting of a molten salt and an organic solvent.

The present invention is also the method for removing a Ti-derived film, wherein the Ti-derived film is a film of titanium-aluminum nitride (TiAlN). Thus, the film of titanium-aluminum nitride (TiAlN) as the Ti-derived film can be removed reliably in a short time.

The present invention is also the method for removing a Ti-derived film, wherein the solution is an aqueous solution containing an alkali hydroxide and hydrogen peroxide.

The present invention is also an apparatus for removing a Ti-derived film, which comprises a tank holding a solution having an $OH^-$ ion concentration of $10^2$ to $10^{-4}$ mol/l, an electrode immersed in the solution, and a power source for applying a positive potential to a member coated with the Ti-derived film, and applying a negative potential to the electrode.

Thus, the Ti-derived film coated on the surface of the member can be removed efficiently by a simple constitution.

The present invention is also the apparatus for removing a Ti-derived film, wherein the solution is an aqueous solution containing an alkali hydroxide and having a pH of 10 or greater, and the tank is provided with a heating means for heating the aqueous solution to a temperature in a range of from room temperature to the boiling temperature of the aqueous solution, and keeping the aqueous solution at this temperature. Thus, the operation of removing the Ti-derived film coated on the surface of the member can be performed easily and in a short time.

BEST MODE FOR CARRYING OUT THE INVENTION

Embodiments of the present invention will now be described in detail by reference to the accompanying drawings.

[First Embodiment]

Figure 1:
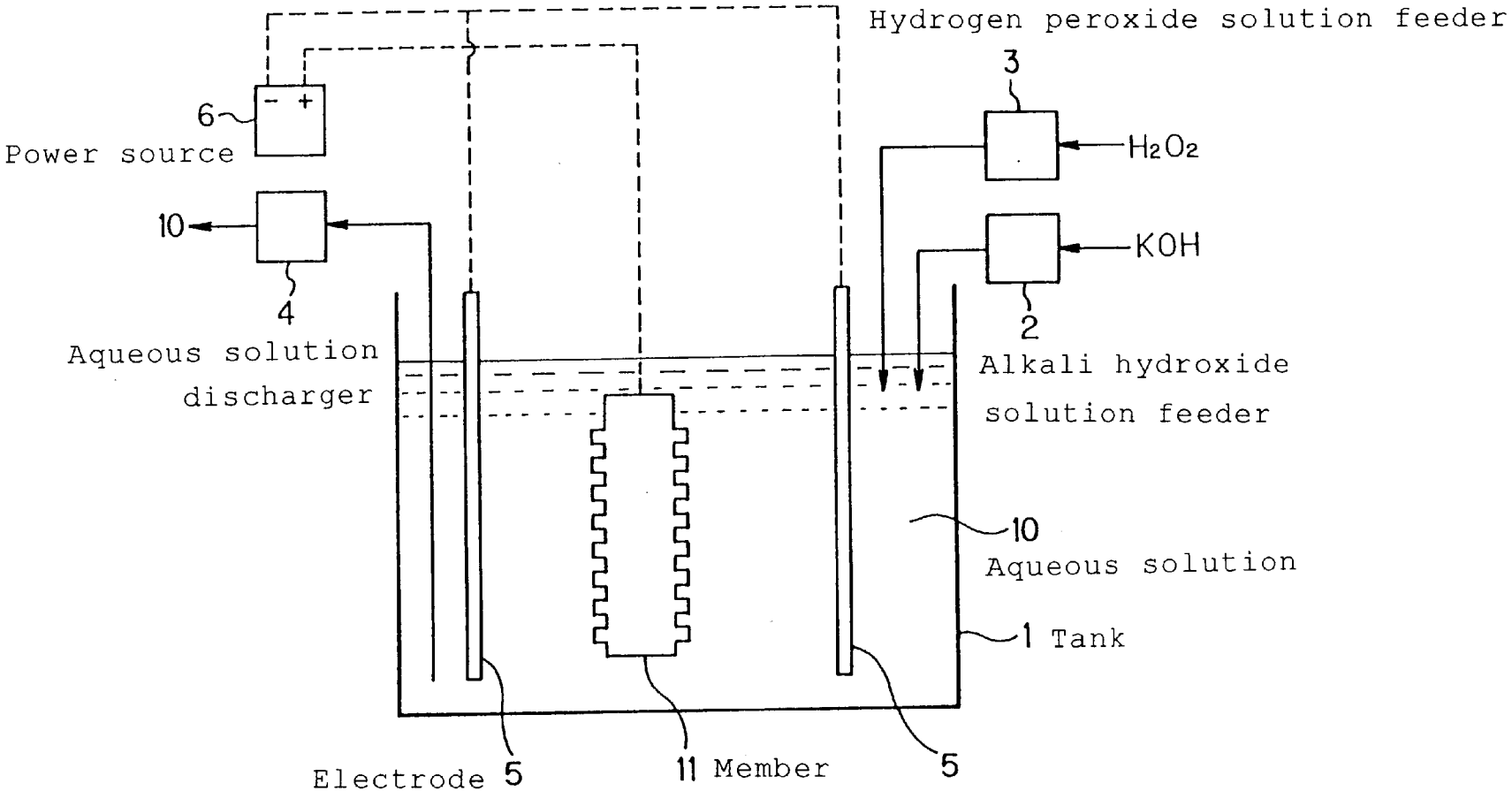
FIG. 1 is a schematic constitution drawing of a removing apparatus for performing a method for removing a Ti-derived film according to a first embodiment of the present invention.

In an apparatus for removing a Ti-derived film according to a first embodiment, as shown in FIG. 1, an aqueous solution 10 containing an alkali hydroxide, such as potassium hydroxide or sodium hydroxide, and hydrogen peroxide, is stored and held in a tank 1. To the tank 1, an alkali hydroxide solution feeder 2 is connected as an alkali hydroxide feeding means for feeding an alkali hydroxide solution of a predetermined concentration in a predetermined amount at intervals of a predetermined time. To the tank 1, a hydrogen peroxide solution feeder 3 is also connected as a hydrogen peroxide feeding means for feeding a hydrogen peroxide solution of a predetermined concentration in a predetermined amount at intervals of a predetermined time. To the tank 1, an aqueous solution discharger 4 is further connected as an aqueous solution discharging means for discharging the stored aqueous solution 10 in a predetermined amount at intervals of a predetermined time.

In the tank 1, an electrode 5 is disposed so as to surround the center of the tank 1, and the electrode 5 is connected to a cathode of a power source 6 disposed outside the tank 1. A member 11 coated with a Ti-derived film is disposed at the center of the tank 1 so as to be surrounded with the electrode 5, and the member 11 is connected to an anode of the power source 6.

A method for removing a Ti-derived film by use of such an apparatus for removing a Ti-derived film according to the present embodiment will be described below.

As described above, in the tank 1 storing the aqueous solution 10 containing the alkali hydroxide and hydrogen peroxide, the member 11 connected to the anode of the power source 6 is disposed, and immersed in the aqueous solution 10, so as to be surrounded with the electrode 5. The feeders 2 and 3 are operated to feed each of an alkali hydroxide of a predetermined concentration and a hydrogen peroxide solution of a predetermined concentration into the tank in a predetermined amount at intervals of a predetermined time. Separately, the discharger 4 is operated to discharge the aqueous solution 10 in the tank 1 in a predetermined amount at intervals of a predetermined time. This procedure always maintains the concentrations of the alkali hydroxide and hydrogen peroxide of the aqueous solution 10 in the tank 1 within constant ranges.

In this state, a negative potential is applied from the power source 6 to the electrode 5, and a positive potential is applied from the power source 6 to the member 11 to flow electricity between the electrode 5 and the member 11 that are immersed in the aqueous solution 10. In this situation, the Ti-derived film coated on the surface of the member 11 is chemically removed by the aqueous solution 10, and is also electrochemically removed.

According to this method of removal, a Ti-derived film can be efficiently removed, in comparison with the conventional removal method that removes the film by immersing it in a predetermined aqueous solution. Thus, the time required for treatment can be shortened markedly, and the cost for the treatment can be reduced.

With a TiAlN film, in particular, treatment for a long time (60 hours) has been unable to remove the film sufficiently. According to the removal method of the present embodiment, by contrast, the film can be removed in a short time (within about 4 hours).

In the above-described embodiment, the electrode 5 receiving a negative potential was immersed in the tank 1 holding the aqueous solution 10. However, it is permissible to use a tank-shaped electrode so that a tank will concurrently serve as an electrode, to store the aqueous solution 10 inside this electrode, and to immerse the member 11 in the aqueous solution 10.

To confirm the effect of the method for removing a Ti-derived film according to the present embodiment, the following confirmation test was conducted based on the above-mentioned embodiment.

[Test Example 1]

<Testing Conditions>

Target member:

Cutting part of hob (outer diameter: 75 mm, length: 150 mm) of high speed tool steel Type of film:

TiAlN film

Thickness of coated film:

2 to 8 μm (7 to 8 μm near tooth top, 2 to 3 μm from side surface to root of tooth)

Content of potassium hydroxide:

15% by weight (pH=14.4)

Content of hydrogen peroxide:

3% by weight

Amount of mixed aqueous solution:

8 liters

Temperature of mixed aqueous solution:

Raised to 40° C. by heat of reaction.

Electric current between member and electrode:

20 A

Voltage between member and electrode:

About 3 to 6 V

<Testing Method>

A hob having a cutting part coated with a TiAlN film is immersed in an aqueous solution containing 15% by weight of potassium hydroxide and 3% by weight of hydrogen peroxide. A positive potential is applied to the hob, while a negative potential is applied to an electrode, to flow an electric current between the hob and the electrode.

<Test Results>

After 4 hours of treatment, the TiAlN film was completely removed from the cutting part of the hob. The film removal rate in this case was 0.5 μm/h or more.

[Test Example 2]

<Testing Conditions>

Target member:

Flat plate (size: 20×20×5 mm) of high speed tool steel

Type of film:

TiCN film

Thickness of coated film:

5 μm

Content of potassium hydroxide:

10% by weight (pH=14.3)

Content of hydrogen peroxide:

1% by weight

Amount of mixed aqueous solution:

500 cc

Temperature of mixed aqueous solution:

Kept at 60° C.

Electric current between member and electrode:

5 A

Voltage between member and electrode:

About 3 to 6 V

<Testing Method>

A flat plate coated with a TiCN film is immersed in an aqueous solution containing 10% by weight of potassium hydroxide and 1% by weight of hydrogen peroxide. A positive potential is applied to the flat plate, while a negative potential is applied to an electrode, to flow an electric current between the flat plate and the electrode.

<Test Results>

After 4 hours of treatment, the TiCN film was completely removed from the flat plate. The film removal rate in this case was 1.2 μm/h or more.

Comparative Example 1

<Testing Conditions>

Target member:

Cutting part of hob (outer diameter: 75 mm, length: 150 mm) of high speed tool steel Type of film:

TiAlN film

Thickness of coated film:

2 to 8 μm (7 to 8 μm near tooth top, 2 to 3 μm from side surface to root of tooth)

Content of potassium hydroxide:

3% by weight

Content of hydrogen peroxide:

5% by weight

Amount of mixed aqueous solution:

10 liters

Temperature of mixed aqueous solution:

Raised to 40° C. by heat of reaction.

<Testing Method>

A hob having a cutting part coated with a TiAlN film is immersed in an aqueous solution containing 3% by weight of potassium hydroxide and 5% by weight of hydrogen peroxide. No electric treatment is performed.

<Test Results>

Even after 120 hours of treatment, the TiAlN film was not completely removed from the cutting part of the hob. The film removal rate was less than 0.1 μm/h.

As stated earlier, the removal method using an apparatus for removing a Ti-derived film of the present embodiment immerses a member coated with a Ti-derived film in an aqueous solution containing potassium hydroxide and hydrogen peroxide, and applies a positive potential to the member, and a negative potential to an electrode, to flow an electric current between the member and the electrode, thereby removing the Ti-derived film. On the other hand, the conventional removal method simply immerses a member coated with a Ti-derived film in an aqueous solution containing potassium hydroxide and hydrogen peroxide, thereby removing the Ti-derived film. Based on the above experimental results, the removal method of the present embodiment, compared with the conventional removal method, can remove the Ti-derived film efficiently, and markedly shorten the time required for treatment, thus decreasing the cost of treatment.

[Second Embodiment]

Figure 2:
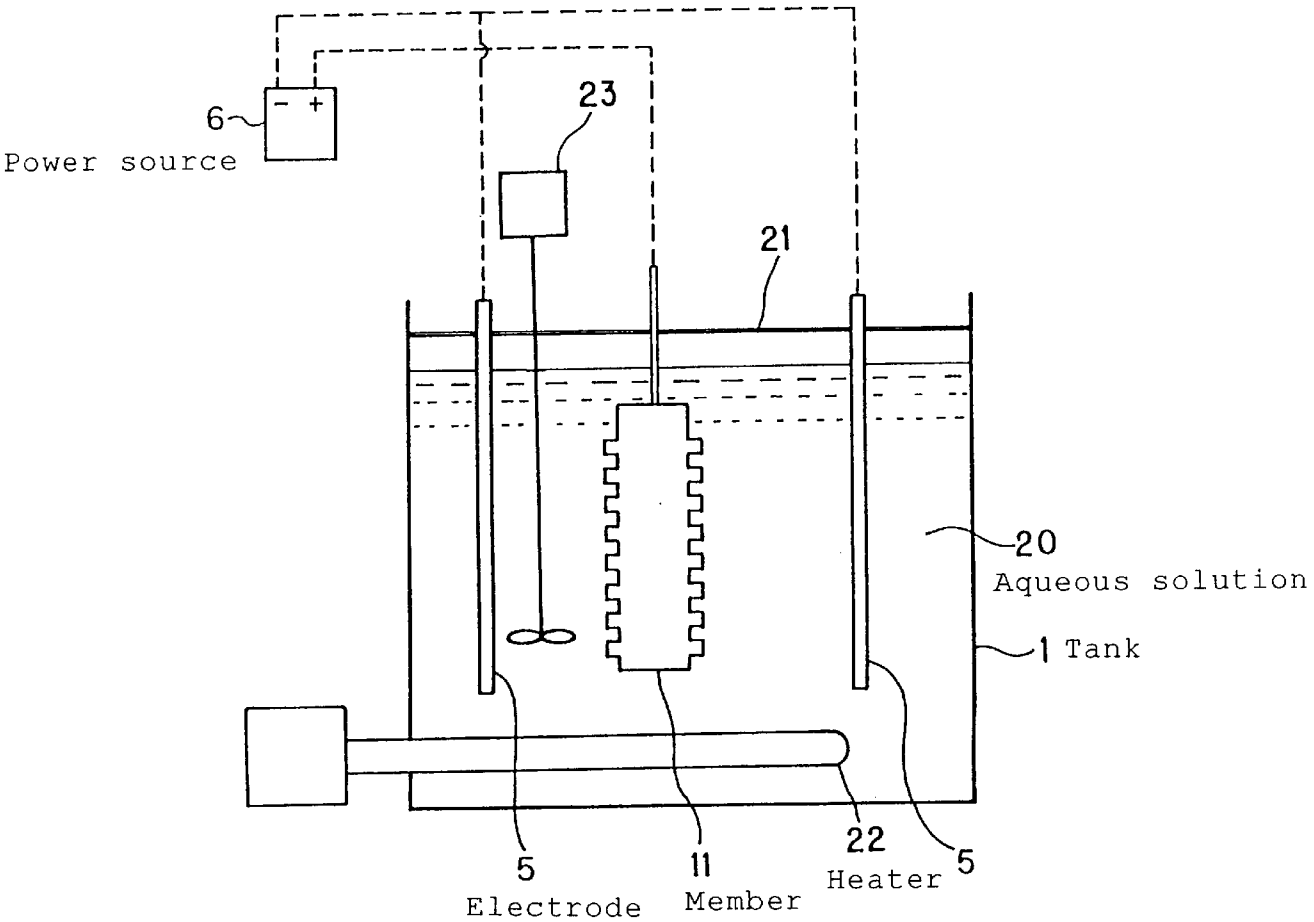
FIG. 2 is a schematic constitution drawing of a removing apparatus for performing a method for removing a Ti-derived film according to a second embodiment of the present invention.

In an apparatus for removing a Ti-derived film according to a second embodiment, as shown in FIG. 2, an aqueous solution 20 containing an alkali hydroxide is stored and held in a tank 1.

In the tank 1, a cylindrical electrode 5 is disposed, and an upper end portion of the electrode 5 is supported by a lid 21 of an insulating material attached to the top of the tank 1. This electrode 5 is connected to a cathode of a power source 6 disposed outside the tank 1. A member 11 coated with a Ti-derived film is disposed at the center of the tank 1 so as to be surrounded with the electrode 5, and the member 11 is connected to an anode of the power source 6.

At a lower part of the tank 1, a heater 22 is provided so that the aqueous solution 20 can be heated with the heater 22. Inside the tank 1, a stirrer 23 is provided to stir the heated aqueous solution 20 so that there will be no nonuniformity in heating. Instead of the heater 22, a temperature controller capable of heating and cooling may be used. The tank 1 may be of a double-layered type in which an inner tank stores the aqueous solution 20, and the electrode 5 is immersed in the aqueous solution 20, while an outer tank is provided with the heater 22 and the stirrer 23.

A method for removing a Ti-derived film by use of an apparatus for removing a Ti-derived film according to the present embodiment will be described below.

In the tank 1 storing the aqueous solution 20 containing the alkali hydroxide, the member 11 connected to the anode of the power source 6 is disposed, and immersed in the aqueous solution 20, so as to be surrounded by the electrode 5, with the upper end portion of the member 11 being supported by the lid 21.

The heater 22 is actuated to heat the aqueous solution 20 in the tank 1 to a higher temperature, and the stirrer 23 is also actuated to stir the aqueous solution 20 being heated.

In this state, a negative potential is applied from the power source 6 to the electrode 5, and a positive potential is applied from the power source 6 to the member 11 to flow electricity between the electrode 5 and the member 11 that are immersed in the aqueous solution 20. In this situation, the Ti-derived film coated on the surface of the member 11 is chemically removed by the aqueous solution 20, and is also electrochemically removed.

Once the temperature of the aqueous solution 20 is raised to an appropriate temperature, the operation of the heater 22 maybe stopped. Thereafter, the aqueous solution 20 is kept at the appropriate temperature by the heat of reaction. The heater 22 and the stirrer 23 are not essential constituents for the removal of the Ti-derived film, and the aqueous solution 20 can be increased in temperature by an electrochemical reaction with the Ti-derived film.

According to the present embodiment, moreover, neither the alkali hydroxide solution feeder nor the aqueous solution discharger 4 is needed, since the aqueous solution 20 is an aqueous solution of an alkali hydroxide. However, as the aqueous solution 20 is heated, water evaporates, and the concentration varies, though slightly. To maintain the aqueous solution 20 at a constant concentration, therefore, a water feeder may be provided.

The reaction for removal of the Ti-derived film by the aqueous solution 20 containing the alkali hydroxide (reaction at an interface between the aqueous solution 20 and the Ti-derived film) may be expressed by the following scheme:

$$TiAlN+5H_2O \rightarrow HTiO_3^- + AlO_2^- + 9H^+ + N\uparrow + 7e^-$$

If the Ti-derived film contains titanium nitride or iron, the reaction is expressed as follows:

$$TiN \rightarrow Ti^{2-} + 1/2N_2 + 2e^-$$

$$Fe+2H_2O \rightarrow HFeO_2^- + 3H^+ + 2e^-$$

According to this method of removal, a Ti-derived film can be efficiently removed, in comparison with the conventional removal method that removes the film by immersing it in a predetermined aqueous solution. Thus, the time required for treatment can be shortened further markedly, and the cost for the treatment can be reduced. In the case of a TiAlN film, in particular, the removal method of the present embodiment can remove the film in a short time (about several minutes). Furthermore, it is permissible to apply a positive potential to the member 11 to flow electricity between the electrode 5 and the member 11 immersed in the aqueous solution 20, while actuating the heater 22 in the initial stage of the test to heat the aqueous solution 20. By so doing, the surface of the member 11 deprived of the Ti-derived film can be finished clean, and nonuniform removal can be avoided.

To confirm the effect of the method for removing a Ti-derived film according to the present embodiment, the following confirmation test was conducted based on the above-mentioned embodiment.

[Test Example 1]

<Testing Conditions>

Target member:

Cutting part of hob (outer diameter: 75 mm, length: 150 mm) of high speed tool steel Type of film:

TiAlN film

Thickness of coated film:

2 to 8 μm (7 to 8 μm near tooth top, 2 to 3 μm from side surface to root of tooth)

Content of potassium hydroxide:

50% by weight (pH=14.9)

Temperature of aqueous solution:

Kept at 80 to 90° C.

Electric current between member and electrode:

100 A

Voltage between member and electrode:

About 4 V

<Testing Method>

A hob having a cutting part coated with a TiAlN film is immersed in an aqueous solution containing 50% by weight of potassium hydroxide. A positive potential is applied to the hob, while a negative potential is applied to an electrode, to flow an electric current between the hob and the electrode.

<Test Results>

After 2 minutes of treatment, the TiAlN film was completely removed from the cutting part of the hob. The film removal rate in this case was 4 μm/min or more.

[Test Example 2]

<Testing Conditions>

Target member:

Flat plate (size: 20×20×5 mm) of high speed tool steel

Type of film:

TiAlN film

Thickness of coated film:

5 μm

Content of potassium hydroxide:

25% by weight (pH=14.6)

Temperature of aqueous solution:

Kept at 40 to 50° C.

Electric current between member and electrode:

30 A

Voltage between member and electrode:

About 2 V

<Testing Method>

A flat plate coated with a TiAlN film is immersed in an aqueous solution containing 25% by weight of potassium hydroxide. A positive potential is applied to the flat plate, while a negative potential is applied to an electrode, to flow an electric current between the flat plate and the electrode.

<Test Results>

After 10 hours of treatment, the TiAlN film was completely removed from the flat plate. The film removal rate in this case was 0.5 μm/h or more.

[Test Example 3]

<Testing Conditions>

Target member:

Cutting part of end mill (outer diameter: 30 mm, length: 100 mm) of high speed tool steel Type of film:

TiN film

Thickness of coated film:

2 to 5 μm

Content of potassium hydroxide:

50% by weight (pH=14.9)

Temperature of aqueous solution:

Kept at 80 to 90° C.

Electric current between member and electrode:

50 A

Voltage between member and electrode:

About 3 V

<Testing Method>

An end mill having a cutting part coated with a TiN film is immersed in an aqueous solution containing 50% by weight of potassium hydroxide. A positive potential is applied to the end mill, while a negative potential is applied to an electrode, to flow an electric current between the end mill and the electrode.

<Test Results>

After 5 minutes of treatment, the TiN film was completely removed from the cutting part of the end mill. The film removal rate in this case was 1 μm/min or more.

Comparative Example 1

<Testing Conditions>

Target member:

Cutting part of hob (outer diameter: 75 mm, length: 150 mm) of high speed tool steel Type of film:

TiAlN film

Thickness of coated film:

2 to 8 μm (7 to 8 μm near tooth top, 2 to 3 μm from side surface to root of tooth)

Content of potassium hydroxide:

3% by weight

Content of hydrogen peroxide:

5% by weight

Temperature of mixed aqueous solution:

Raised to 40° C. by heat of reaction.

<Testing Method>

A hob of high speed tool steel having a cutting part coated with a TiAlN film is immersed in an aqueous solution containing 3% by weight of potassium hydroxide and 5% by weight of hydrogen peroxide. No electric treatment is performed.

<Test Results>

Even after 60 hours of immersion treatment, the TiAlN film was not completely removed from the cutting part of the hob, and the surface was discolored to become black.

As stated earlier, the removal method using an apparatus for removing a Ti-derived film of the present embodiment immerses a member coated with a Ti-derived film in an aqueous solution containing potassium hydroxide, and applies a positive potential to the member, and a negative potential to an electrode, to flow an electric current between the member and the electrode, thereby removing the Ti-derived film. Based on the above experimental results, the removal method of the present embodiment, compared with the conventional removal method, can remove the Ti-derived film efficiently, and markedly shorten the time required for treatment, thus decreasing the cost of treatment.

Based on the above two embodiments, and the test examples, when the concentration of potassium hydroxide in the aqueous solution 10 or 20 is higher, removal of the film is performed more easily and in a shorter time. Concretely, the aqueous solution preferably has a pH of 10 or greater. When the hydrogen peroxide is used, its amount is preferably 10% by weight or more.

The temperature of the aqueous solution 10 or 20 may be kept in a range of from room temperature to the boiling temperature of the aqueous solution used. Preferably, it is from about 20 to 200° C., for example.

The electric current applied from the power source 6 to the electrode 5 and the member 11 is preferably high, and the preferred current for practical use is about 5 to 60 A.

In the aforementioned embodiments, the aqueous solution 10 containing an alkali hydroxide and hydrogen peroxide, or the aqueous solution 20 containing an alkali hydroxide was used as the solution of the present invention. However, the aqueous solution of the invention may be one containing ammonia. Not only an aqueous solution, but a solution of an alkali hydroxide melted in a solvent consisting of a molten salt and an organic solvent may be used as the solution of the invention. Even in this case, a hydroxyl group, which the molten salt has, may be liberated, whereupon a reaction expressed by the aforementioned reaction scheme may take place at the interface between the molten salt and the Ti-derived film to be removed. That is, the present invention may use a solution having an $OH^-$ ion concentration of $10^2$ to $10^{-4}$ mol/l, and can thereby exhibit the aforementioned actions and effects.

Industrial Applicability

As described above, the method and apparatus for removing a Ti-derived film according to the present invention immerses an electrode and a member coated with the Ti-derived film in an aqueous solution containing an alkali hydroxide, and applies a positive potential to the member and a negative potential to the electrode, to flow an electric current between the electrode and the member, thereby removing the Ti-derived film efficiently in a short time. The method and apparatus are preferred for use in recycling of cutting tools of high speed tool steel, etc. for improved wear resistance.

What is claimed is:

1. A method for removing a Ti-derived film, comprising:

heating an aqueous solution containing an alkali hydroxide having a pH of 10 or greater to a predetermined temperature;

immersing an electrode and a member coated with the Ti-derived film in the solution at the predetermined temperature; and applying a positive potential to the member, and a negative potential to the electrode.

2. The method for removing a Ti-derived film as claimed in claim 1, wherein the temperature of the aqueous solution is kept not higher than the boiling temperature of the aqueous solution.

3. The method for removing a Ti-derived film as claimed in claim 1, wherein the aqueous solution is kept at a predetermined temperature by initially raising its temperature by heating, and then raising its temperature by the heat of reaction.

4. The method for removing a Ti-derived film as claimed in claim 1, wherein the solution is a solution of an alkali hydroxide melted in a solvent consisting of a molten salt and an organic solvent.

5. The method for removing a Ti-derived film as claimed in claim 1, wherein the Ti-derived film is a film of titanium-aluminum nitride (TiA1N).

6. The method for removing a Ti-derived film as claimed in claim 1, wherein the solution is an aqueous solution containing an alkali hydroxide and hydrogen peroxide.

7. An apparatus for removing a Ti-derived film, comprising:

a tank for holding an aqueous solution containing an alkali hydroxide having a pH of 10 or greater;

a heating means for heating the solution in the tank to a predetermined temperature or higher;

an electrode adapted for immersion in the solution; and a power source for applying a positive potential to a member coated with the Ti-derived film, and applying a negative potential to the electrode.

8. The apparatus for removing a Ti-derived film as claimed in claim 7, wherein the tank is provided with a temperature control means for controlling the temperature of the aqueous solution to a temperature not lower than the predetermined temperature but not higher than the boiling temperature of the aqueous solution.

* * * * *